US005876835A

United States Patent [19]

Noble et al.

[11] Patent Number: 5,876,835

[45] Date of Patent: Mar. 2, 1999

[54] MOLDED STRESSED-SKIN PANELS

[75] Inventors: Robert L. Noble, Encinitas; Timothy L. Newburn, Huntington Beach; Colin S. Jessop, San Diego; Jonathan D. Masters, Long Beach, all of Calif.

[73] Assignee: Gridcore Systems International, Long Beach, Calif.

[21] Appl. No.: 758,239

[22] Filed: Nov. 27, 1996

Related U.S. Application Data

[63] Continuation-in-part of Ser. No. 561,612, Nov. 21, 1995, abandoned.

[51] Int. Cl.[6] ..... B32B 3/00; B32B 1/26; D21F 13/00

[52] U.S. Cl. ..... 428/156; 428/167; 428/192; 428/213; 264/86; 264/257; 264/313; 425/84; 425/86; 425/403.1; 425/447; 425/DIG. 119; 162/223; 162/224; 162/382

[58] Field of Search ..... 428/120, 119, 428/212, 178, 156, 167, 192, 213; 425/500, 324.1, 84, 86, 80.1, 403.1, 405.1, 447, DIG. 119; 264/239, 86, 87, 84, 119, 241, 257, 313, 517, 518; 162/383, 225, 119, 124, 223, 224, 382

[56] References Cited

U.S. PATENT DOCUMENTS

| | | | |
|---|---|---|---|
| D. 296,701 | 7/1988 | Lindell | 15/135 |
| 3,192,589 | 7/1965 | Learson | 24/204 |
| 3,290,421 | 12/1966 | Miller | 264/219 |
| 3,354,248 | 11/1967 | Haas | 264/119 |
| 3,449,207 | 6/1969 | Modersohn | 162/411 |
| 3,989,581 | 11/1976 | Kober | 156/510 |
| 4,061,813 | 12/1977 | Geimer | 428/183 |
| 4,070,515 | 1/1978 | Smarook | 428/92 |
| 4,162,877 | 7/1979 | Nyberg | 425/84 |
| 4,289,793 | 9/1981 | Gustafson | 426/491 |
| 4,388,263 | 6/1983 | Prunty | 264/257 |
| 4,440,708 | 4/1984 | Haataja | 264/109 |
| 4,702,870 | 10/1987 | Setterholm | 264/87 |
| 4,753,713 | 6/1988 | Gunderson | 162/383 |
| 4,784,813 | 11/1988 | Schlor | 264/86 |
| 4,867,670 | 9/1989 | Munk | 425/344 |
| 4,931,241 | 6/1990 | Freitag | 264/86 |
| 4,940,563 | 7/1990 | Kromrey | 264/257 |
| 4,960,553 | 10/1990 | DeBruine | 264/113 |
| 5,045,262 | 9/1991 | Munk | 264/112 |
| 5,119,531 | 6/1992 | Berger | 24/576 |
| 5,190,773 | 3/1993 | Damon | 425/186 |
| 5,198,167 | 3/1993 | Ohta | 264/86 |
| 5,198,236 | 3/1993 | Gunderson | 425/80.1 |
| 5,204,042 | 4/1993 | James | 264/257 |
| 5,277,854 | 1/1994 | Hunt | 264/86 |
| 5,314,654 | 5/1994 | Gunderson | 264/517 |
| 5,441,675 | 8/1995 | Souders | 264/25 |

FOREIGN PATENT DOCUMENTS

WO 92/21499 12/1992 WIPO .

*Primary Examiner*—Donald Loney
*Attorney, Agent, or Firm*—Knobbe, Martens, Olson & Bear, LLP

[57] ABSTRACT

Stressed-skin panels are provided having internal open-cell grids molded from material such as fibers, and methods and apparatus for the production thereof are disclosed. The invention utilizes a porous screen having a plurality of elastomeric pads spaced apart thereon. Fiber dispersed in fluid is introduced into the apparatus and over and around the pads. Pressure exerted thereon expels fluid through the screen and consolidates the fibers to form a panel. The pads are designed and constructed in a manner so as to consolidate the fiber mat located below the pads compressed by the pressure, so that the finished panel includes an integrally-molded flange. The height, shape and/or spacing of the pads in the present invention advantageously provide improved mold release and greater resistance to compression set after repeated use. The pads provide greater consistency and improved quality in the flange formation on the panels.

71 Claims, 6 Drawing Sheets

MOLDED STRESSED-SKIN PANELS

RELATED U.S. APPLICATION

This is a continuation-in-part of U.S. application Ser. No. 08/561,612 titled MOLDED STRESSED-SKIN FIBER PANELS, filed Nov. 21, 1995, now abandoned.

FIELD OF THE INVENTION

The present invention relates to stressed-skin panels and panel assemblies, and more particularly, to molded stressed-skin panels containing internal open-cell grids, and to methods and apparatus for producing such panels, as well as mold elements useful in such production.

BACKGROUND OF THE INVENTION

Softwood and hardwood lumbers have long been used as structural components in the construction industry, due to their desirable strength characteristics, relatively low cost and ease of manufacture and working. As the cost of lumber has increased, alternatives such as hardboard have been selected, due to their lower cost. Hardboard usually consists of a cellulose fiber, water and a binder such as latex, starch or urea formaldehyde. However, all of these alternatives tend to suffer from depletion, low strength-to-weight ratio, or the use of undesirable solvents or binders in their manufacture or processing.

For many years, corrugated fiberboard has served as a basic, light weight material for packaging and other light duty applications. Corrugated fiberboard is made from flat fiberboard material. A single sheet is corrugated to form the middle core, or corrugated medium. This requires a separate operation. Adhesive is then applied to the nodes of either one or both sides of the corrugated middle core, and then bonded to one or two flat sheets, respectively. The shape of the core is maintained by the bonds. However, panels of corrugated fiberboard are relatively weak, and do not lend themselves to structural applications.

It has also been known to produce certain pulp molded articles, such as egg cartons, pots for flowers, baskets, and the like. These products are made on rigid molds. The mold is often semi-porous and is covered with screening material. A vacuum is pulled at the back of the mold, causing flow through the screen and the mold so that the fibers form a uniform mat over the screen. The mat on this rigid mold is consolidated with a mating reverse shaped solid mold pressed against the mat on the forming mold. This consolidates the mat between the two mating molds. The direction of the consolidation force is perpendicular to the mat. However, such articles lack the strength to be useful as structural components.

To increase the strength of formed panels, it has previously been known to produce stressed-skin panels for use as structural components. Such panels are considered advantageous due to their high strength-to-weight ratio. However, the high cost of fabrication has limited the commercial practicality of such components to high cost, exotic applications.

Previously, such panels were constructed in layers, wherein a skin layer is affixed to an internal grid, commonly called a "honeycomb." These honeycombs are often fabricated from flat sheets or strips of paper or paper-like materials, which are combined by means of spaced spots of glue. The assemblage is pressed and then the adhesive is allowed time to cure. A second skin is often applied in a similar manner, and the assemblage is trimmed to the desired dimensions.

Prior methods of forming stressed-skin structural panels are found in U.S. Pat. Nos. 4,702,870, 4,753,713, 5,198,236, 5,277,854, and 5,314,654.

More recently, the basic components of stressed-skin panels have been molded from various fiber materials. Two such components are then glued together to form the complete panel. See, for example, U.S. Pat. No. 4,702,870. Panels constructed in this manner provide advantages over the prior art, namely, the avoidance of a number of gluing and other fabrication steps, and the greater flexibility of production of many different sorts of open cell grids.

However, the finished panels produced in accordance with the prior art generally require at least one gluing step, and the attendant manipulations, thus adding to the cost. Furthermore, the surface area available to be utilized as a contact area for the glue is generally rather small, so that minor misalignments between the two layers would substantially lessen the strength of the glue bond.

This prior art also embodies fundamental limitations on the production of such panels and on the panels so produced. The mold inserts used in the prior art to form the internal grid suffered from compression set, whereby repeated use changed the shape of the inserts. This leads to a) poor grid formation, producing weaker and inconsistent products; b) interference with the product panel in the mold, producing poor release and possible product damage and requiring use of mold release agents and manpower that increases costs and also diminishes product quality; c) increasing production time, thereby increasing costs and severely limiting the ability of such products to compete with other, less expensive materials; and d) limitations on the raw materials that would be useful.

In the present invention it has been discovered that new mold insert shapes and arrangements avoid these disadvantages and produce superior panels under production techniques that open the door for such panels to compete with a wider range of current products.

SUMMARY OF THE INVENTION

The present invention provides for the production of molded, stressed-skin structural panels containing internal open-cell grids in a highly advantageous and inexpensive manner. Thus, in a preferred embodiment of the invention, stressed-skin fiber panels are provided which increase the surface area used to form a glue contact area between layered panels or panel assemblies. In another embodiment of the invention, there are provided stressed-skin fiber panels which can be fabricated in a single step to include a second skin covering a substantial portion of the internal open cell grid.

In the invention, the material of the panel, preferably fiber, is dispersed in a fluid is introduced into a mold, comprising a lower screen or porous carrier above which are mounted a plurality of resilient mold inserts. The inserts are of a resiliency, shape and spacing such that pressure applied to the inserts causes them to flatten and entrap material/fluid mix between and, at least partially, under them. Pressure applied to the material/fluid mix consolidates the material in these areas and expels fluid through the screen or carrier. This apparatus and process produces open cells having ribs that are formed between the mold inserts and flanges integrally molded to and across such ribs which are formed under and adjacent the flattened mold inserts.

The present invention provides several improvements over the prior art, including 1) improved uplift during removal of the molds from the panel, 2) reduced surface area for sticking to the top of the mold to the panel during removal of the panel, 3) greatly reduced instances of damage to the flanges and/or pads during removal of the panel from the carrier, 4) improved resistance to compression "set" which occurs in the elastomeric material after repeated use during manufacture of the panels, and/or 5) enhanced rib and flange production leading to stronger panels. The overall effects are greatly increased efficiency in the manufacturing of molded stressed-skin fiber panels and material and labor costs reduction. In addition, the need for mold release agents is reduced, thereby being better for the environment and additionally reducing material costs.

The panels of this invention can advantageously be fabricated out of cellulose material, such as wood fibers, recycled paper and wood products, and the like. The fibers can be non-cellulose materials, including animal fibers, such as wool, or textile fibers such as cotton, or synthetic fibers such as various plastics and fiberglass, as well as mineral fibers such as rock wool, and the like. Examples of agricultural fibers include kenaf, and rice or wheat straw. Agricultural waste material such as palm fronds is yet another possible fiber source. Other materials that can be dispersed in fluid, preferably liquid can be used, such as cement, plaster and gypsum.

Thus, in one aspect of the present invention, resilient mold inserts or pads are provided to serve not only to establish the initial shape of the grid, but also to determine its consolidation. These pads are of a predetermined shape and size, and are located in a predetermined relation to each other on the carrier. The manner of selecting the size, shape and spacing of these pads on the carrier determines the nature of the finished product, as will appear from the detailed specification below.

The pads are preferably uniformly shaped, sized and arranged on the carrier so as to produce panels with uniform and repetitive cells.

An important relationship in the present invention is between the height of these pads and the distance between them. It has been discovered that this relationship contributes to the advantages described above, and in particular to enhanced rib and flange formation. Preferably, the ratio of the distance between the pads to their height above the carrier is 0.15 to 0.5, more preferably from 0.2 to 0.4.

In the arrangement of the pads on the carrier, an increased spacing is provided such that drain rate, and water vapor pass-through rate, is improved. Further, the spacing in the present invention allows longer fibers to be deposited between the pads, thereby increasing the types of raw materials which can be used. This includes use of high quality long fiber raw materials and also use of less costly raw material processing and pulping of virgin and recycled fibers. The resultant flanges and ribs in the panels of the present invention are thicker and more consistent, and have greater crush strength and shear resistance, and also provide superior bonding surfaces for panel lamination or the like.

The present elastomeric pads preferably have a height to base width ratio of at least 0.85, more preferably between 0.85 and 2.0, such as between 0.9 and 1.8, and most preferably about 0.95 and 1.5. In these values, the height is measured as the height effectively available for molding (i.e., above the carrier) and in an uncompressed, or relaxed state. The base width, measured under similar conditions, is the greatest dimension adjacent the bottom of the pad above the carrier.

In another aspect of the present invention, elastomeric pads are provided with upright side surfaces that are substantially concave. In a preferred embodiment, the pads are tapering with sides that are bi-angular, i.e., with sides that rise at one angle to their longitudinal axis and then at another, more tapering angle. In one particularly preferred embodiment, a lower portion of each pad forms an angle measured normal to the pad base which is about 15 degrees, and an upper portion of the pad forms an angle of about 8 degrees. Various cross-sectional shapes, taken parallel to the pad bottom, or the carrier may be used, including hexagonal, round, oval, square, or rib-like.

Embodiments of this invention provide porous carriers or screens bearing a plurality of the above elastomeric pads, as well as apparatus and processes for producing panels using such pads.

In yet another aspect, the present invention provides molded panels having on one side a substantially continuous skin integrally-molded with a grid comprising a plurality of open cells defined by a plurality of ribs having their thicknesses parallel to the plane of the grid and their heights defining the thickness of the grid. On the side opposite the integrally-molded grid, the panels have integrally molded flanges which extend over at least a portion of the surface area of each cell of the grid and are substantially parallel to the panel skin.

Thus, in cross-section through such a panel skin, rib and flange, the rib and flange together form a generally "T"-shaped member integrally molded with, and extending outwardly from, the panel skin or face. The ratio of the overhang of the flange from the rib portion to the width of the flange is an important feature of the present invention and preferably is at least 0.1, more preferably from 0.3 to 0.4.

In another aspect, the present invention produces panels of a monolithic, one-piece character, having stressed-skin layers on both sides of the open cell grid. The panels are thus formed in accordance with the invention in final form, and therefore do not require any additional assembly and/or attendant handling. In this aspect, the integrally-molded flanges form a second stressed-skin fibre member, wherein the second member extends over a substantial portion of the surface area of each cell of the grid.

In yet another aspect, the present invention provides an apparatus for making such molded stressed-skin panels, preferably fiber panels. The apparatus preferably includes a porous carrier having a plurality of elastomeric pads located thereon, each of the pads having a predetermined spacing, size and/or shape as described above and in more detail below, so as to consolidate the fiber mat beneath the pad when the pad is compressed. The apparatus further comprises a press to consolidate the fiber, deposited on the carrier covering and filling the spaces between and above the pads, in directions both normal and parallel to the carrier by applying pressure normal to the carrier on the pads on the ends thereof remote from the carrier. The pads are thus caused to expand parallel to the carrier to compress the fibers located therebetween, as well as to consolidate the fibers located above and below the pads.

A further aspect of the invention provides a method for producing such molded stressed-skin panels, using the apparatus described herein, and wherein a carrier fluid is utilized to contain the panel material. The carrier fluid moves through the apparatus, depositing the material between and above the resilient pads. After the material is deposited, the resultant grid is consolidated by the application of pressure to the tops of the pads. As this pressure is applied, the pads compress in the direction of the applying force, but they also expand at right angles thereto, thus reducing the spaces between the pads where the material is located. The pads are also designed so as to consolidate the material mat in the space proximate the carrier upon compression of the pad. Thus, the deposited material between the pads is consolidated both vertically and horizontally into an open cell grid, the material above the pads is compacted to form a first molded skin integral with the grid, and the material in the region surrounding the base of the compressed pads is compacted to form a flange integrally-molded with the grid, which covers at least a portion of the surface area of each cell.

Further advantages and applications will become apparent to those skilled in the art from the following detailed description of the preferred embodiments and the drawings referenced herein, the invention not being limited to any particular embodiment.

DETAILED DESCRIPTION OF THE PREFERRED EMBODIMENTS

The invention will be better understood with reference to the accompanying drawings which form a part of this disclosure, and wherein:

Generally, in panels of the type in this invention, and prior art panels, there are industry standards for dimensions. A panel as formed in the present invention may be used as a subpanel in a panel assembly and bonded to another subpanel to form a panel of standard thickness. Industry standards for plywood and particle board include thicknesses of 0.5, 0.625, 0.75, and 1.25 inches. Thus, in the following detailed description, specific dimensions are related to a standard thickness panel. Specifically, such dimensions relate to the formation and/or sizes of a panel that is nominally 0.375 inches thick and which when bonded to a similar panel produces a product having a nominal thickness of 0.75 inches. In the present panels, skin thickness, i.e., face thickness, up to about 0.125 inches is preferable, with 0.04 to 0.065 inches most preferable.

Figure 1:
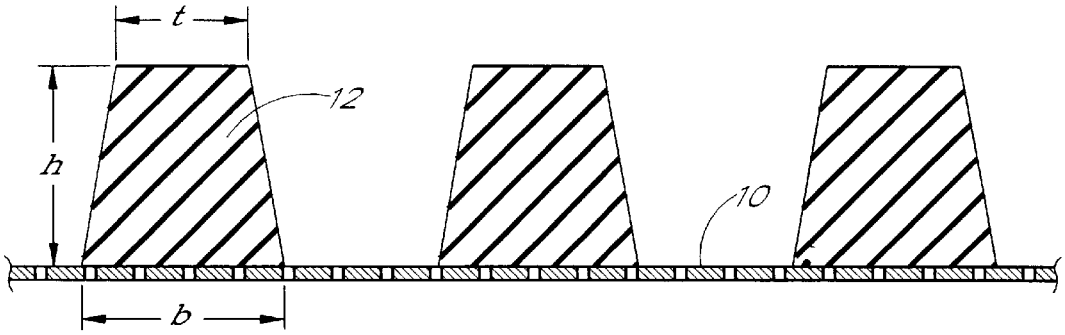
FIG. 1 is a side elevation view illustrating a carrier and a series of elastomeric pads in accordance with the invention.

FIG. 1 depicts an embodiment of the present invention which utilizes a porous carrier 10, which may be in the form of a screen, a belt, a wheel, a roller, or the like, and which will generally be made from metal, plastic, or other material capable of withstanding the pressure generated during the present method. This porous carrier can be stationary, for batch type processing production of the present panels, or can be a moving member so as to form a part of a continuous production process.

A wire mesh, such as a stainless steel or bronze screen, may be used for example. Such wire meshes are typically used in the manufacture of paper and cardboard, or non-flange, products. However, it has been found that a metal screen having larger holes than typically used by the paper and cardboard industries is preferable for faster drain time in the present invention. Further, such a screen does not tend to stretch out with use to the degree of wire mesh screens. Preferably, a stainless steel screen is used as the carrier 10. The holes in the carrier 10 should be large enough to drain the carrier fluid quickly without draining the fibers through as well.

Suitably fixed to the porous carrier 10 are elastomeric pads 12 which will define, by their geometry and the spaces therebetween, the configuration of the grid in the structural panels to be produced in accordance with the invention. The pads 12 will generally be evenly distributed across the surface of carrier 10, most usually in a geometric pattern. The pads may be attached to the carrier by use of SILASTIC 736 adhesive by Dow Corning in Michigan, for example, by casting or by any mechanical method known to those skilled in the art. Preferably, the ratio of the distance between the pads to their height above the carrier is 0.15 to 0.5, more preferably from 0.2 to 0.4.

The pads are spaced more than 0.050 inches apart on the carrier. Preferably, in the panel of 0.375 inch thickness, spacing of about 0.060 to 0.200 inches, and more preferably from 0.130 to 0.180 inches, between the pads may be used, although the spacing can be varied according to the carrier used and the desired panel characteristics. Most preferably, a spacing of about 0.160 inches is used between the pads. The increased spacing between the pads allows high quality longer fibers to be used to form quality panels without extended drain times during manufacture.

The present pads may be formed of any sufficiently elastomeric material capable of withstanding the heat, steam and pressure of the panel molding process, over extended cycles of use. Further, the elastomeric material should not stick to the pressed panel such that release of the panel is impeded and/or damage to the pads occurs. Silicone rubber, such as SILASTIC HS by Dow Corning, or KE1300 (base) with CAT L5 (catalyst) by Shinetsu Co. in Los Angeles, has been found to be particularly useful in this regard. Although, synthetic or natural rubbers, such as other silicone rubbers, styrene-butadiene elastomers, or isoprene, having the aforementioned performance characteristics may alternatively be used for the pads.

Other means for providing the features of the present invention include the durometer rating of the elastomeric pad, where a softer, more pliable pad will be expected to increase the amount of fiber mat which is consolidated during the press stage in the area surrounding the base of each pad. The chosen rating should provide high enough shear strength under the tensile-compressive load cycling that occurs during manufacture of the panels. Preferably, the Shore A hardness will be from about 15 to 45, more preferably 20 to 35. Most preferably, the Shore A hardness of the pad is about 27. It should be noted that the preferred durometer rating is dependent upon, among other things, the fibers used in the panel, since using too hard of a pad will tend to create flanges that will peel away from the rib of the panel during removal of the panel from the carrier.

In a preferred embodiment of the invention, the elastomeric pads are hexagonal in cross section, so as to form hexagonal cells in the grid of the panels. It will be readily apparent that numerous other geometric shapes may be employed in creating elastomeric pads, the selection of which will determine the form of cells contained in the present grids. Although, it has been observed that some other pad shapes may form substantially hexagonal cells as well, due to the close arrangement of the pads on the carrier. Referring to FIG. 1, a ratio of the nominal dimension or diameter of the bottom of the pad b to the dimension or diameter of the top t, or b/t, is preferably about 1.0–1.7, more preferably, 1.1 to 1.7, and most preferably about 1.4.

Figure 7:
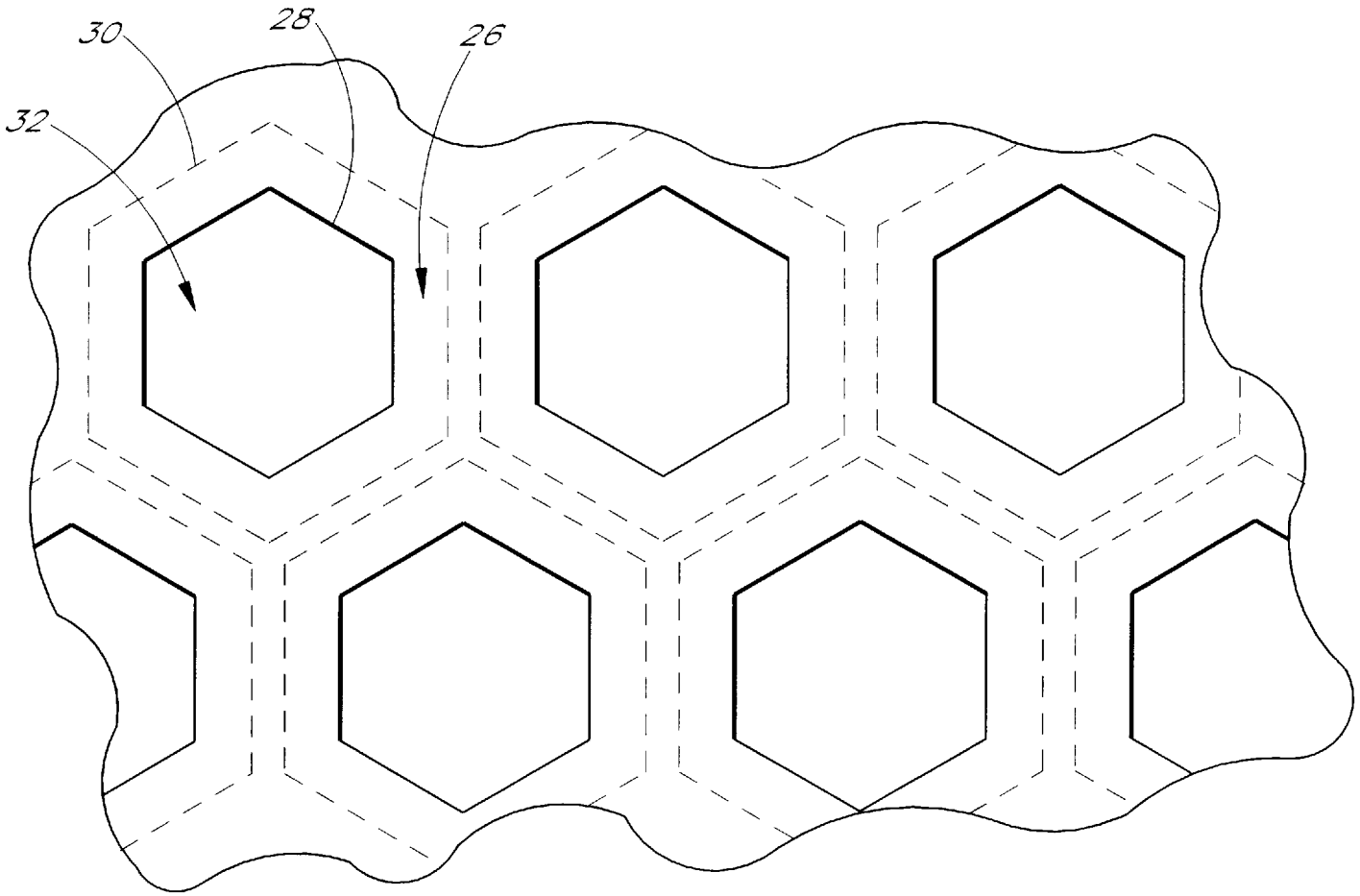
FIG. 7 is a bottom plan view of the panel of FIG. 6, illustrating the flanges extending over a portion of the surface area of each of the open cells in the grid of the panel.

Referring to FIG. 7, the present elastomeric pads serve not only to establish the initial shape of the grid, but also to determine its consolidation and integration with the commonly-formed stressed-skins and flanges. The pads are of a predetermined shape and size, and are located in a predetermined relation to each other on the carrier. The manner of selecting the size, shape and spacing of these pads on the carrier determines much of the nature of the finished product. For example, in forming panels of the present invention, the pads will typically be more widely spaced than the pads in the prior art for forming a panel of comparable overall dimensions. In the present invention, the taller pads are able to maintain comparable thickness and height of the grid formed in the panel while providing a greater densification of the fibers as well as a wider flange.

As shown in FIG. 1, a preferred embodiment of a pad of the present invention comprises a top surface which is substantially parallel to the carrier 10, a body portion, and a base portion. In the cross-section shown, the top of the pad has a height h measured from the carrier which is at least about 85% of the width b of the base of the pad. Generally, the dimension or width t of the pad top will be less than the base dimension b. Preferably, the height to base width ratio, h/b, is about 0.85–2.00 (85 to 200 percent), more preferably is about 0.90–1.80 (90 to 180 percent), and most preferably is about 0.95–1.50 (95 to 150 percent).

Figure 10:
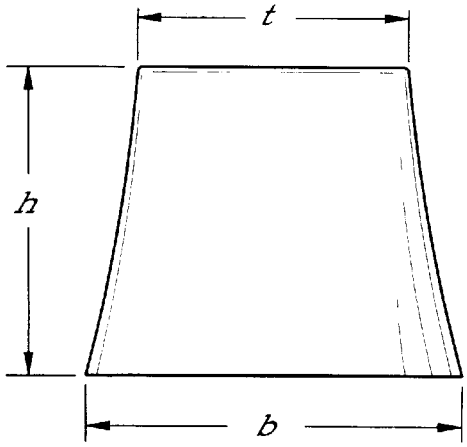
FIG. 10 is a side elevation view of one embodiment of a pad viewed above the carrier.
Figure 11A:
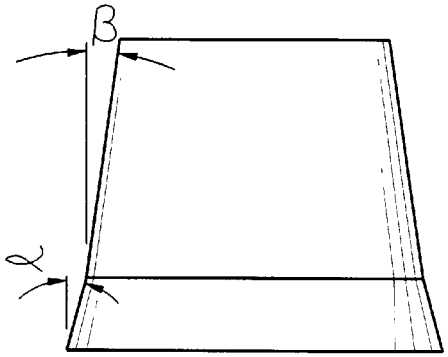
FIG. 11A is a side elevation view of a preferred embodiment of a pad viewed above the carrier.
Figure 11B:
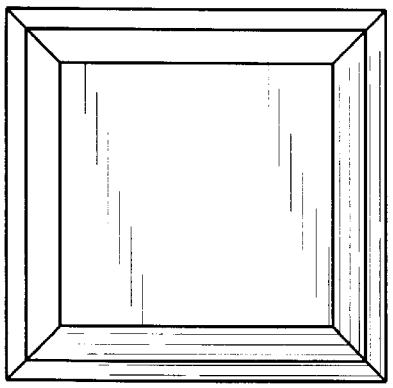
FIGS. 11B–11C are top plan views of various embodiments of the pad.
Figure 11C:
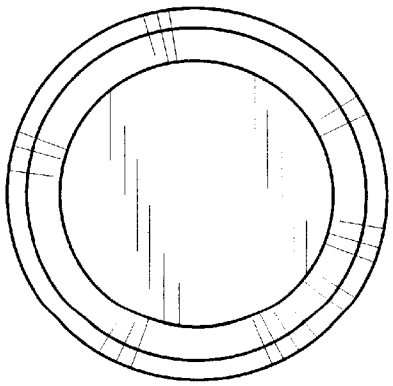
Figure 12A:
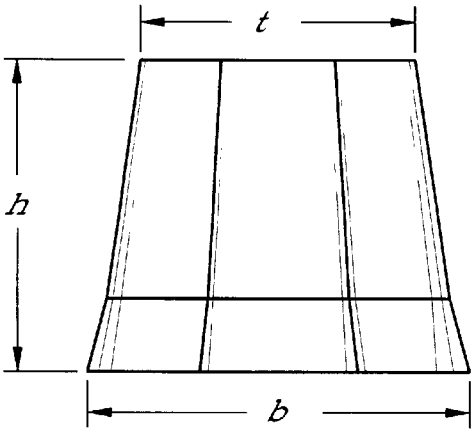
FIG. 12A is a side elevation view of another preferred embodiment of a pad viewed above the carrier.
Figure 12B:
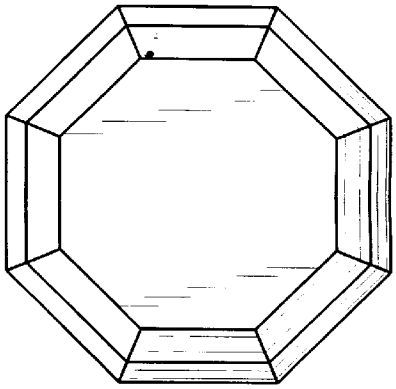
FIGS. 12B–12D are top plan views of various embodiments of the pad.
Figure 12C:
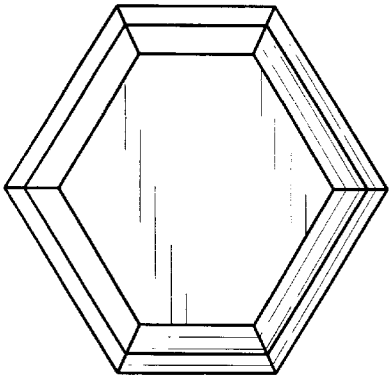
Figure 12D:
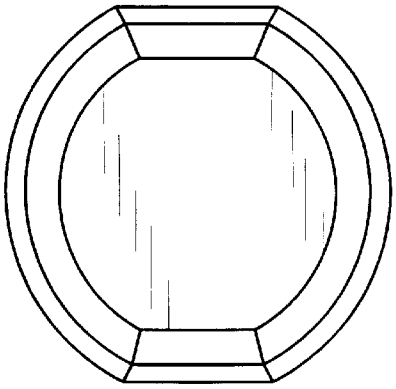

Referring now to FIGS. 10, 11A–11C, and 12A–12D, preferred shapes of a pad of the present invention comprises substantially concave sides, wherein FIG. 10 may have round or square cross-section (not shown) taken in a plane parallel to the carrier. FIGS. 11A–11C and 12A–12D illustrate possible shapes of a pad having a "bi-angular" shape of the present invention, wherein the general curvature is defined by two substantially linear sections forming two angles which are measured relative to the longitudinal axis of the pad. A lower side surface of a bi-angular pad forms a first angle $\alpha$, and an upper side surface of the bi-angular pad forms a second angle $\beta$. The first angle $\alpha$ is generally greater than the second angle $\beta$. Preferably, $\alpha$ is about 15 degrees and $\beta$ is about 8 degrees.

In one embodiment of the present invention, the subject pads are of sufficient height and elasticity so that, when pressure is applied normal to the carrier, the fiber material around the base of the pad, where it is affixed to the carrier, will be compressed and consolidated against the carrier. This occurs because the fixation of the pad to the carrier reduces its local ability to expand in a direction parallel to the carrier surface. The resulting pressure entraps and consolidates a portion of the fiber mat surrounding the base of the pad.

Depending upon the height, cross-sectional area and elasticity of the pad, this portion of the fiber mat can form a flange member integrally-molded with the ribs of the open cell grid and parallel to the carrier. Such flanges can be relatively narrow, covering only a small portion of the surface area of the open cell grid, for example greater than 0%, preferably greater than approximately 5%, and from about 25% up to approximately 40% of the cell surface area. Although, one can obtain many of the benefits of the flange when it covers approximately 5 to 15% of the surface area of the cell. Such a flange will strengthen the grid, enhance the rigidity of the panel, and provide an increased contact area when it is desired to adhere two panels together to form a multi-layer stressed-skin fiber panel.

At the other extreme, the integrally-molded flange can extend to cover a substantial portion of the surface area of the cell formed in the grid by the compressed pad, thereby forming a second stressed-skin integral with the grid of the present panels. The amount of the cell surface area covered by this flange, or second "skin," can vary widely, for example from at least about 10% of the surface area and up to about 90%, and preferably 15–40%, most preferably 15–20%, of the surface area. The practical limits of the amount of surface area which can be covered are dictated to a great degree by the base area of the elastomeric pad 12 which is affixed to the carrier 10. One can obtain the benefit of these embodiments of the flange, or second stressed-skin, when the flange covers approximately 15% of the surface area of the cell. However, greater flange overhang is preferred, about 25–40%.

For a panel of about 0.375 inch thickness, the flanges preferably have widths of at least about 0.060 inches, preferably between about 0.060 and 0.200 inches, more preferably between about 0.130 and 0.180 inches, and most preferably about 0.160 inches. Spacing between the mold inserts or pads, in preferred embodiments of the invention, are of similar dimensions.

Alternatively, in certain embodiments of the invention, the elastomeric pads will be formed on the carrier in a "bilayer" fashion, wherein the base of the pad will be formed of a relatively less elastic material, and the remainder will be of greater elasticity. This feature will have the effect of the increasing the amount of fiber mat consolidated below the compressed pad, and thus the thickness and strength of the flange.

In this regard, it is important to note that when producing a true stressed-skin fiber panel, it is desirable to establish a balance between the compressive and tensile forces borne by the skins. Given that the skin on one face of the present panel will cover 100% of the surface area of the cells of the grid, and that the flange or skin on the other face will cover less than 100%, it may be desirable to provide a flange which is thicker than the first skin, so that the relative strengths of the two faces of the panel are more closely balanced.

Alternatively, the flange or second skin could be impregnated, for example with any of a number of known materials such as resins, so as to alter the modulus of elasticity, thereby affecting the balance of the relative strengths as described above. That is, in at least the flanges, the use of a resin with a high modulus can compensate for the face strength when the flange covers less of the cell surface area than about 50%. This additive may be preferable to laminating another sheet or skin onto the face of the panel. Since the panel is not a solid member, the "apparent" modulus of elasticity of the panel is measured using conventional methods for comparison with fiberboards and the like.

It will be recognized that after a certain period of use, elastomeric pads such as employed in the present invention may develop a "set" or deformation which causes them to change their profile. Typically, elastomeric pads become shorter and wider after repeated use. Thus, the shape of the pads in the present invention provide the advantage of anticipating this deformation by providing a compensatory shape, such as shown in FIGS. 1, 10, 11A–11C, and 12A–12D.

Figure 2:
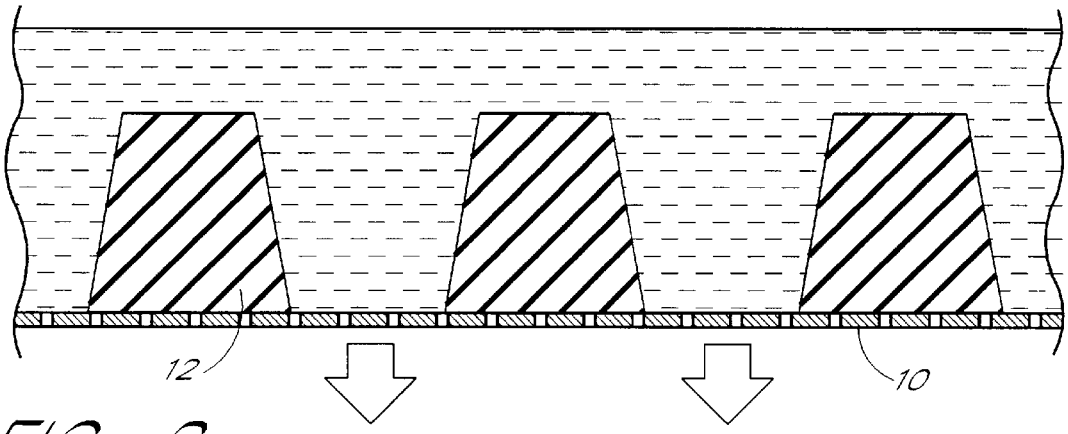
FIG. 2 is a side elevation view illustrating the deposition of carrier liquid containing fibers onto the apparatus of FIG. 1 and the release of a portion of the carrier liquid through the porous carrier.

One embodiment of the method of the invention will now be described by reference to the drawings, wherein FIG. 2 illustrates the flow-through deposition of previously prepared fibers in a liquid carrier medium onto the porous carrier 10 and between and on top of the elastomeric pads 12. The transporting fluid can be water, air, foam or other media, although water is preferred. Flow-through deposition of fibers is a well known technology, and it is one advantage of the invention that it uses this developed technology.

The fibers used in the present panels can be derived from cellulose material, such as wood fibers, recycled paper and wood products, and the like, agricultural, animal or textile fibers. Additionally, the fibers can be derived from noncellulose material, including synthetic fibers such as various plastics and fiberglass, as well as mineral fibers such as rock wool, and the like. Also of use in the present panels will be mixtures of fibers of various kinds, whether cellulose or noncellulose in origin. See for example, the specifications of U.S. Pat. Nos. 4,702,870, 4,753,713, 5,198,236, 5,277,854, and 5,314,654.

Examples of agricultural fibers include kenaf, which is used for paper making. Rice or wheat straw, alone or in "fiber alloys," are also potential panel fiber sources. Agricultural waste material, such as palm fronds, is yet another possible fiber source. Animal fibers include wool, and textile fibers include cotton, where the wool and cotton may be recycled fibers. Other materials that can be dispersed in fluid, preferably a liquid, can be used, such as cement, plaster and gypsum.

Preferred fibers include recycled paper products such as old corrugated containers (OCC), recycled high quality kraft paper, and undeliverable standard mail (USM). The OCC fibers have fast forming time in the panel molding process and provide good fiber bonds. The kraft paper is generally more expensive but drains quickly. Generally, lower cost fibers have a higher rate of contamination which can increase drain time as well as adversely affect the strength of the panel.

As the fibers are deposited, and for a time thereafter, an initial densification of the fiber mat as well as removal of much of the water or other carrier fluid will occur naturally by gravity and/or by pressure differential, the outflow of the fluid being illustrated by the large arrows in FIG. 2. The pressure differential may be created by a vacuum below the porous carrier 10 or increased ambient pressure above the deposited fibers. This initial densification can be accomplished by a "pre-pressing" step. Nevertheless, a single press phase is presently preferred. Typical press times are from 10 to 30 minutes. Typical drain times are from 30 to 120 seconds.

Figure 3:
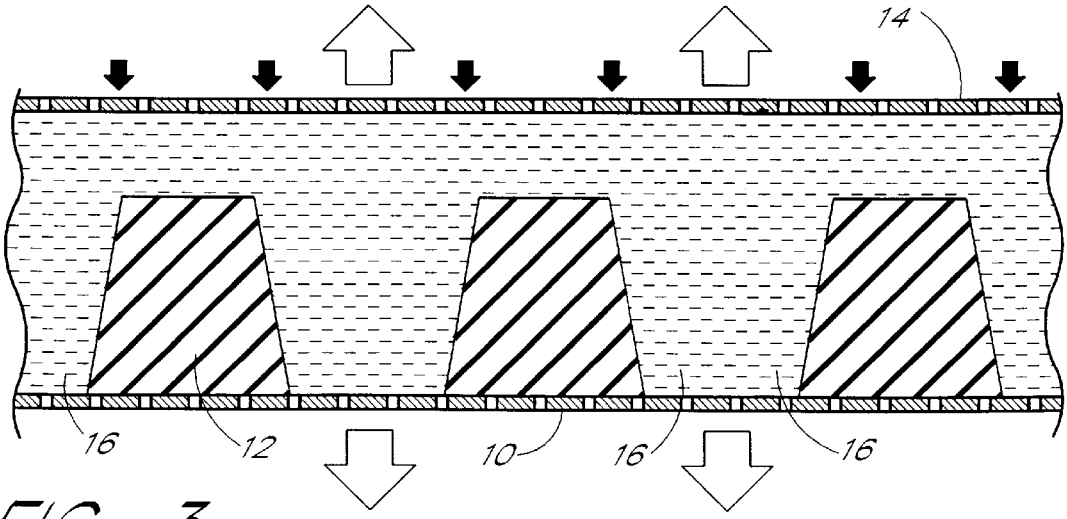
FIG. 3 is a side elevation view illustrating the use of a top mold to apply pressure to the fiber mat and elastomeric pads in a direction normal to the carrier, and the release of a portion of the carrier liquid through the porous carrier and the top mold.

FIG. 3 shows the condition of the deposited fibers after the gravity and/or pressure differential step, wherein the fibers are more or less uniformly distributed between and above the pads. At this stage, these loosely distributed fibers as shown in FIG. 3 have very little structural integrity.

FIG. 3 further shows the initiation of a pressing step using a movable top mold 14, as shown by the small arrows of the figure, a significant feature of certain embodiments of the present invention. During this step, the elastomeric pads 12 will be deformed slightly in response to the normal pressure applied by the top mold 14 as it moves toward the carrier 10.

For final pressing, a range of pressures from about 20–400 PSI is possible, and a range of between 100–200 PSI is preferred, with 156 PSI most preferred in one embodiment of the method of the present invention. Temperatures of about 212°–400° F. for water-based carrier fluid is preferred to achieve at least water boiling temperature, more preferably from about 300° to 400° F., and a temperature of 315° F. is most preferred in one embodiment of the present method.

In addition, it will be appreciated that the deformation response of the pads is not solely parallel to the normal force exerted by the moving top mold 14. This is due to the particular nature of the resilient materials utilized to fabricate the pads 12. It will also be seen in FIG. 4 that the base portion of the elastomeric pads 12 has not expanded horizontally as far as the mid portion, resulting in the exertion of a consolidation force applied toward the carrier 10 in the regions 16 surrounding the base of each pad 12, producing a consolidation and compression of the fibers surrounding the base of the pad.

Figure 4:
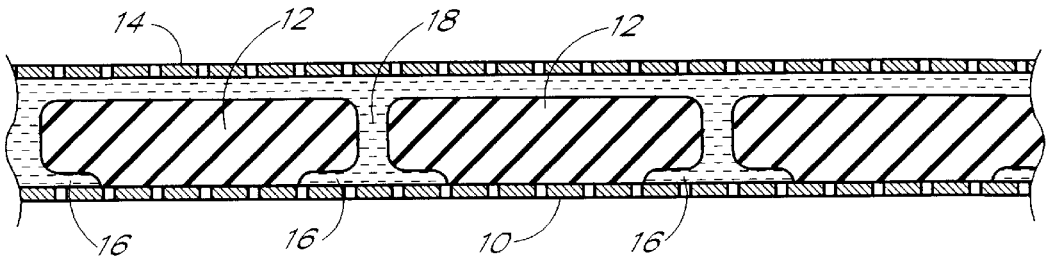
FIG. 4 is a side elevation view illustrating the increase in pressure applied by the top mold to the fiber mat and elastomeric pads, and the formation of flanges in the regions surrounding the bases of the pads.

In addition, the pressing step depicted in FIGS. 3 and 4 removes additional carrier fluid, the outflow of the fluid being illustrated by the large arrows in FIG. 3. The top mold 14 can also be porous carrier and the carrier fluid can thus exit both through the porous carrier 10 as before and also through the top mold 14. Thus, as is clear from FIG. 4, the normal force applied at the top mold 14 produces three-dimensional densification of the deposited fibers due to the resiliency of the elastomeric pads 12.

Figure 5:
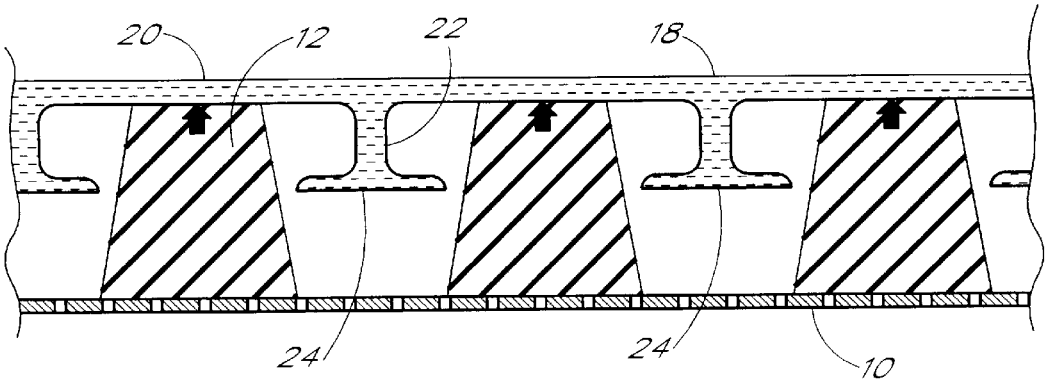
FIG. 5 is a side elevation view illustrating the release of pressure applied by the top mold to the fiber mat and elastomeric pads.

The force applied in this pressing step depicted in FIG. 4 is sufficient to give the panel 18 depicted in FIG. 5 sufficient structural strength that it may be removed from the carrier 10 and, if desired, transferred to a new location for further processing. The elastomeric pads 12 in the present invention advantageously provide uplifting force to separate the panel 18 from the carrier 10, as illustrated by the arrows in FIG. 5. It may be desirable to use air pressure applied through the carrier 10 to facilitate the removal of the panel. Additional processing may include another pressing, trimming of the panel, or other finishing activities to prepare the panel according to the customer's specifications.

Figure 6:
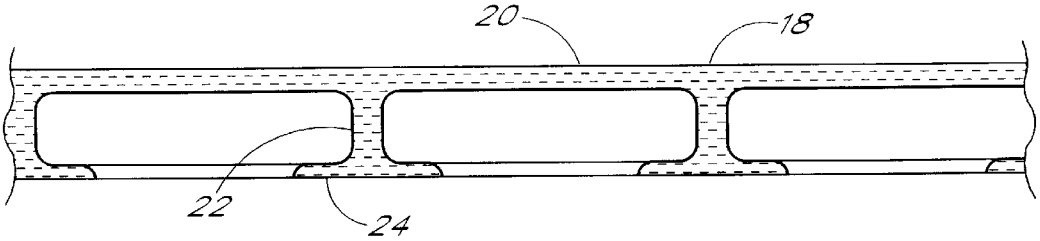
FIG. 6 is a side elevation view illustrating a panel formed in accordance with the invention.

As depicted in FIGS. 6 and 7, panels produced in accordance with the invention are characterized by having a surface skin 20 on one side formed in cooperation with the top mold 14, and webs or other configurations forming the open cell grid 22 which extend generally normal to the surface skin 20. The remaining side of the panel 18 will have a flange or second skin 24 integrally-molded with the ribs forming the open cell grid 22, formed by the consolidation of fibers in the regions 16 surrounding the bases of the elastomeric pads 12. This flange or second skin 24 will cover a portion 26 of the surface area of each cell in the grid 22 of the panel 18, which portion can be varied by adjusting the dimensions and elasticity of the pad 12, as described heretofore. The portion 26 of the surface area so covered will be bounded by the edge 28 of the flange and wall 30 of the rib which forms a portion of grid 22. The remaining portion 32 of the surface area of the cell, through which the elastomeric pad 12 projected from the carrier 10, will thus remain uncovered.

Continuing the explanation of the example herein using a two-stage process, as depicted in FIGS. 1–4, the intermediate formed panel 18, which has been subjected to a prepressing primarily to eliminate excess fluid, can now be subject to a consolidation in the same apparatus or, optionally, transferred to a second apparatus (not depicted in the figures) comprising a second porous carrier on which are mounted a second set of elastomeric pads, which cooperate with a second top mold. The elements 10, 12 and 14 in FIGS. 1–4 are similar and functionally equivalent to the elements of this second stage, the dimensions and configurations being determined in order to produce the final finished panel as described in greater detail below.

Utilization of a normal pressing force produces advantages for the invention. These advantages include energy savings in that a normal force is relatively easy to apply, and further, that the use of energy is less than would be required in other systems wherein forces must be applied in multiple directions to the mat to produce the finished part.

FIG. 4 also illustrates the final step in this embodiment of the invention. By simply holding the top mold 14 in place for a predetermined length of time, which is set by the nature of the panel 18 and of the fibers and the like used in its construction, final curing or drying of the fiber structure can be accomplished at this last step, and heat may also be applied at this point. This can be done in ways well known to those skilled in these arts, by providing heating means in conjunction with either one or both of the porous carriers and the top molds.

In one preferred embodiment shown in FIGS. 11A–11C and 12A–12D, the pads are approximately 0.560 inches in diameter at their base and have a height of about 0.580 inches above the carrier. The lower portion of the pad extends to about 0.115 inches above the carrier, and the upper portion of the pad extends an additional 0.465 inches.

Figure 6A:
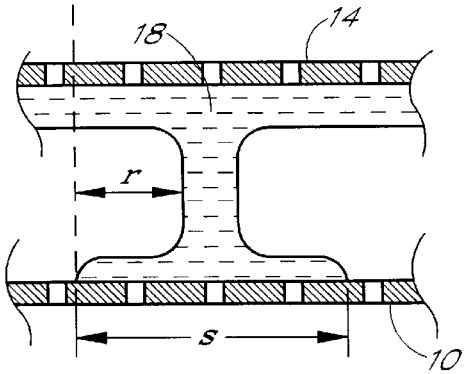
FIG. 6A is a detail view of a flange and rib formed in accordance with the invention.
Figure 9:
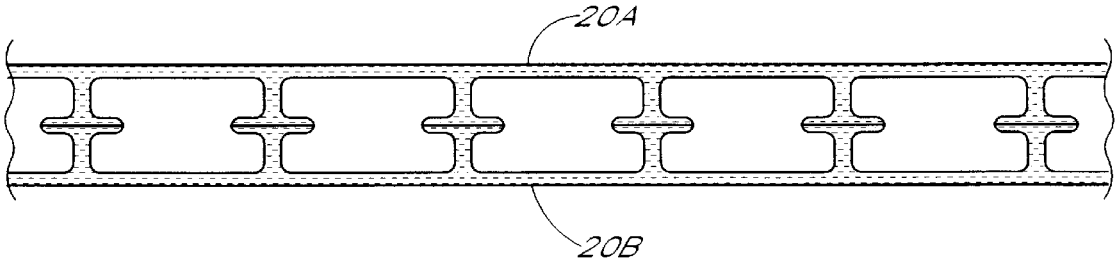
FIG. 9 is a side elevation view of two subpanels joined together.

The resultant cell and flange dimensions from these pads are a rib height, or maximum distance from the surface of the cell to the furthermost surface of the flange, of about 0.305 inches, with a cell thickness of about 0.065 inches, such that the total distance from the first skin to the second skin or side of the panel is about 0.375 inches. Thus, subpanels joined together at their flanges, as shown in FIG. 9, have a total thickness of about 0.75 inches. The flange width measured between the cells is about 0.160 inches. FIG. 6A shows the relation between the flange overhang r to the distance between the pads s. Preferably, a ratio r/s of greater than 0.1, or 10%, is formed, and more preferably the ratio is 0.3 to 0.4, or 30 to 40%.

Thus, it has been seen that a process of the character described has been provided. The example of the two-stage process utilizing a first molding as depicted in FIGS. 1–4 and a second molding is not considered limiting, since the result could be accomplished in a single stage as depicted in FIGS. 1–4 or in further multiple stages in the event that the panel is particularly complex in nature or requires further densification. In the event of a one-stage process using the present apparatus, the completion of densification may be accomplished simply by holding top mold 14 in place for a predetermined length of time which is set by the nature of panel 18 and the fibers and the like used therein. In such a one-step process, final curing or drying of the fiber structure is accomplished as the last step of FIG. 4, and heat also may be applied at this point as well.

Technology presently exists to automate the processes of the invention so that the structural parts can be produced in continuous form or as individual elements. Other variations and equivalents will present themselves to those skilled in these arts.

Figure 8:
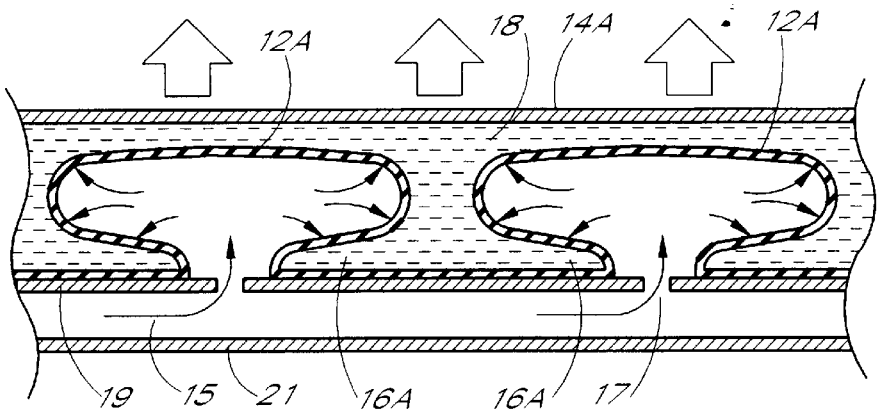
FIG. 8 is a side elevation view illustrating an alternative embodiment of an apparatus of the invention comprising a carrier, air supply tubes, and inflatable membrane.

Various embodiments of the invention can also utilize an inflatable, flexible membrane 12A shown in FIG. 8 which is preferably made of elastomeric material similar to the pads 12 of FIGS. 1–5. An air or other pressurized fluid supply network 15 is provided, and openings 17 through the carrier 19 are provided to inflate the membranes. A top mold 14A, analogous to the top mold 14 of FIGS. 3–4, is also provided. In operation, instead of the three dimensional force being generated internally within the material of pads 12 as a response to the normal pressing force, the fluid pressure under the active parts of the membrane services this function. In addition, by appropriate design, the membranes can be constructed to provide analogous compressive regions 16A around the base, in order to form the consolidated flange or second skin of panel 18, as described previously.

The use of solid elastomeric pads as in FIGS. 1–5 is deemed preferable where the overall thickness of the article being manufactured is relatively low. The inflatable membrane may be preferable where the overall thickness of the part being manufactured is relatively high. However, these considerations are not definitive, and there is substantial overlap as to the parts being made. Other factors also go into the choice of which embodiments of the invention to use, such as the type of fibers, the density of the final product, and like factors known to those skilled in these arts.

The molded stressed-skin fiber panels formed in accordance with the present invention can be used to make structural wall panels, insulating panels by filling the internal spaces with fiberglass or other insulating material, and for floors, doors, ceiling tiles, and for other such members. The panels could replace existing drywall as well. A polyurethane or other coating may be used to waterproof the panels, for use outdoors.

Any adhesive suitable for the fibers used in the skin 20A or 20B of the subpanel may be used to bond subpanels together at the flange skins as illustrated in FIG. 9. For example, an adhesive such as a polyvinyl acetate, or Alvar, may be used when wood fibers are used.

The invention can also be used in combination with resins mixed in with the fibers. In such case, the heat could serve the additional function of setting up the final product by curing such resins. Wet strength additives such as KYMENE or HERCON available, for example, from Hercules Inc. of Wilimington, Del., may be used, for example. It may be necessary to hold the pressure on the panel, as in FIG. 4, for a sufficient period of time to permit the curing of the resin. However, depending upon the particular resin, heat may not be required at all.

Thus, it can be seen that both basic variations of the invention include as pads solid or substantially solid blocks of resilient material, as well as inflatable membranes of the alternative embodiments hereinbefore described.

Although the foregoing invention has been described in some detail by way of illustration and example for purposes of clarity and understanding, it will be apparent to those of ordinary skill in the art in light of the teaching of this invention that certain changes and modifications may be made thereto without departing from the spirit or scope of the appended claims.

What is claimed is:

1. An apparatus for making molded panels comprising a porous screen and a plurality of elastomeric pads mounted thereon, each of said pads having a base portion and a body portion above said base, said base having a width greater than or equal to the width of the body, said pads having a height to base width ratio of from about 0.85 to 2.0, said pads being compressible and adapted to form a panel surface having integrally molded thereto an open cell grid comprising ribs substantially normal to said surface and having a flange substantially parallel to said surface when material is deposited and consolidated around said pads.

2. The apparatus of claim 1, wherein the height to base width ratio is from about 0.9 to 1.8.

3. The apparatus of claim 1, wherein the ratio of the spacing between said pads to their height is from 0.15 to 0.50.

4. The apparatus of claim 1, wherein said pads have sides extending away from said screen and said sides are substantially concave and extend generally towards each other.

5. The apparatus of claim 4, wherein said sides are bi-angular.

6. The apparatus of claim 1, further comprising a press.

7. The apparatus of claim 1, wherein said pads are spaced from about 0.060 to 0.200 inches apart on the screen.

8. The apparatus of claim 1, wherein each of said pads has a top width and said pads have a base width to top width ratio of from 1.0 to 1.7.

9. The apparatus of claim 1, wherein said pads have a cross-section of substantially hexagonal shape.

10. The apparatus of claim 1, wherein said pads have a Shore A hardness of from 15 to 45.

11. The apparatus of claim 1, wherein said pads are made of silicone rubber.

12. An apparatus as claimed in claim 1, wherein said pads are formed from at least two layers: a first base layer formed of a first elastic material and an upper layer formed of a second elastic material, said first elastic material being less elastic than the second elastic material.

13. A method for making molded panels comprising a sheet having a plurality of ribs and flanges extending therefrom to form an open cell grid, said method comprising:

providing a porous screen to permit expulsion of fluid therethrough;

providing a plurality of elastomeric pads spaced apart on said screen to serve as molds for forming the open cells of said grid, each of said pads having a base portion and a body portion above said base, said base having a width greater than or equal to the width of the body, said pads having a height to base width ratio of from about 0.85 to 2.0.

depositing said material dispersed in fluid onto said screen and around said pads; and consolidating said deposited material and fluid around said pads by compressing said pads to deform them in a direction substantially parallel to said screen, said pads being deformed so that they overhang said screen;

whereby said material is consolidated between said pads and under said overhangs to form on a surface of said panel ribs substantially normal to said surface and having flanges substantially parallel to said surface and across said ribs to form an open grid cell on said panel.

14. The method of claim 13, wherein the deposited material and fluid around the pads are consolidated using a porous press.

15. The method of claim 13, wherein the height to base width ratio is from about 0.9 to 1.8.

16. The method of claim 13, wherein the ratio of the spacing between said pads to their height is from 0.15 to 0.50.

17. The method of claim 13, wherein said pads have sides extending away from said screen and said sides are substantially concave and extend generally towards each other.

18. The method of claim 17, wherein said sides are bi-angular.

19. The method of claim 13, wherein the ratio of the overhang of each pad, when compressed, to the distance between the pads is at least 0.1.

20. The method of claim 13, wherein said pads are spaced from about 0.060 to 0.200 inches apart on the screen.

21. The method of claim 13, wherein each of said pads has a top width and said pads have a base width to top width ratio of from 1.0 to 1.7.

22. The method of claim 13, wherein said pads are made of silicone rubber.

23. The method of claim 13, wherein each of said pads has a cross-section of substantially hexagonal shape.

24. The method of claim 13, wherein said pads have a Shore A hardness of from 15 to 45.

25. A method as claimed in claim 13, wherein said pads are formed from at least two layers: a first base layer formed of a first elastic material and an upper layer formed of a second elastic material, said first elastic material being less elastic than the second elastic material.

26. A method as claimed in claim 13, which comprises the further steps of adhering flanges of one panel to flanges of another panel and forming a panel assembly having a nominal thickness of about 0.5, 0.625, 0.75 or 1.25 inches.

27. A method as claimed claim 26, wherein said thickness is about 0.75 inch.

28. A plurality of elastomeric pads for use in an apparatus for making molded panels, each of said pads having a base portion and a body portion above said base, said base having a width greater than or equal to the width of the body, said pads having a height to base width ratio of from about 0.85 to 2.0, each of said pads having a generally flat top and said pads having a base width to top width ratio of from 1.0 to 1.7 said pads being compressible and adapted to form a panel surface having integrally molded thereto an open cell grid comprising ribs substantially normal to said surface and having a flange substantially parallel to said surface when material is deposited and consolidated around said pads.

29. The pads of claim 28, wherein the height to base width ratio is from about 0.9 to 1.8.

30. The pads of claim 28, wherein each of said pads has sides on its body which are substantially concave and extend above the base generally towards each other.

31. The pads of claim 28, wherein said pads have a base width to top width ratio of from 1.1 to 1.7.

32. The pads of claim 28, wherein each of said pads has a top width and said pads have a base width to top width ratio of from 1.0 to 1.7.

33. The pads of claim 28, wherein each of said pads has a cross-section of substantially hexagonal shape.

34. The pads of claim 28, wherein said pads have a Shore A hardness of from 15 to 45.

35. The pads of claim 28, wherein said pads are made of silicone rubber.

36. The pads of claim 28, wherein said pads are formed from at least two layers: a first base layer formed of a first elastic material and an upper layer formed of a second elastic material, said first elastic material being less elastic than the second elastic material.

37. An apparatus for making molded panels comprising a porous screen and a plurality of elastomeric pads mounted thereon, each of said pads comprising a base, a top and sides extending therebetween, said top and base being substantially parallel to each other and said sides being substantially concave and extending generally towards each other said pads being compressible and adapted to form a panel surface having integrally molded thereto an open cell grid comprising ribs substantially normal to said surface and having a flange substantially parallel to said surface when material is deposited and consolidated around said pads.

38. The apparatus of claim 37, wherein said sides are bi-angular.

39. The apparatus of claim 37, wherein said base has a width and the height to base width ratio of said pads is from about 0.85 to 2.0.

40. The apparatus of claim 37, wherein the ratio of the spacing between said pads to their height is from 0.15 to 0.50.

41. The apparatus of claim 37, further comprising a press.

42. The apparatus of claim 37, wherein said pads are spaced from about 0.060 to 0.200 inches apart on the screen.

43. The apparatus of claim 37, wherein each of said pads has a top width and said pads have a base width to top width ratio of from 1.1 to 1.7.

44. The apparatus of claim 37, wherein each of said pads has a cross-section of substantially hexagonal shape.

45. The apparatus of claim 37, wherein said pads are made of silicone rubber.

46. The apparatus of claim 37, wherein said pads have a Shore A hardness of from 15 to 45.

47. An apparatus as claimed in claim 37, wherein said pads are formed from at least two layers: a first base layer formed of a first elastic material and an upper layer formed of a second elastic material, said first elastic material being less elastic than the second elastic material.

48. A method for making molded panels comprising a sheet having a plurality of ribs and flanges extending therefrom to form an open cell grid, said method comprising:

providing a porous screen to permit expulsion of fluid therethrough;

providing a plurality of elastomeric pads spaced apart on said screen to serve as molds for forming the open cells of said grid, each of said pads having sides being substantially concave and extending generally towards each other;

depositing said material dispersed in fluid onto said screen and around said pads; and consolidating said deposited material and fluid around said pads by compressing said pads to deform them in a direction substantially parallel to said screen, to form overhangs between said pads and said screen;

whereby said material is consolidated between said pads and under said overhangs to form on a surface of said panel ribs substantially normal to said surface and flanges substantially parallel to said surface and across said ribs to form an open grid cell on said panel.

49. The method of claim 48, wherein the deposited material and fluid around the pads are consolidated using a porous press.

50. The method of claim 48, wherein said sides are bi-angular.

51. The method of claim 48, wherein said pads have a base having a width and the height to base width ratio of said pads is from about 0.85 to 2.0.

52. The method of claim 48, wherein the ratio of the spacing between said pads to their height is from 0.15 to 0.50.

53. The method of claim 48, wherein the ratio of the overhang of each pad, when compressed, to the distance between the pads is at least 0.1.

54. The method of claim 48, wherein said pads are spaced from about 0.060 to 0.200 inches apart on the screen.

55. The method of claim 48, wherein each of said pads has a top having a width and said pads have a base width to top width ratio of from 1.1 to 1.7.

56. The method of claim 48, wherein said pads are made of silicone rubber.

57. The method of claim 48, wherein each of said pads has a cross-section of substantially hexagonal shape.

58. The method of claim 48, wherein said pads have a Shore A hardness of from 15 to 45.

59. A method as claimed in claim 48, wherein said pads are formed from at least two layers: a first base layer formed of a first elastic material and an upper layer formed of a second elastic material, said first elastic material being less elastic than the second elastic material.

60. A method as claimed in claim 48, which comprises the further steps of adhering flanges of one panel to flanges of another panel and forming a panel assembly having a nominal thickness of about 0.5, 0.625, 0.75 or 1.25 inches.

61. A method as claimed claim 60, wherein said thickness is about 0.75 inch.

62. A plurality of elastomeric pads for use in an apparatus for making molded panels, each of said pads comprising a base, a top and sides extending therebetween, said top and base being substantially parallel to each other and said sides being substantially concave and extending generally towards each other, each of said pads having a generally flat top and said pads having a base width to top width ratio of from 1.0 to 1.7 said pads being compressible and adapted to form a panel surface having integrally molded thereto an open cell grid comprising ribs substantially normal to said surface and having a flange substantially parallel to said surface when material is deposited and consolidated around said pads.

63. The pads of claim 62, wherein said sides are bi-angular.

64. The pads of claim 62, wherein said pads have a base width to top width ratio of from 1.1 to 1.7.

65. The pads of claim 62, wherein said top has a width and said pads have a base width to top width ratio of from 1.1 to 1.7.

66. The pads of claim 62, wherein each of said pads has a cross-section of substantially hexagonal shape.

67. The pads of claim 62, wherein said pads have a Shore A hardness of from 15 to 45.

68. The pads of claim 62, wherein said pads are made of silicone rubber.

69. The pads of claim 62, wherein said pads are formed from at least two layers: a first base layer formed of a first elastic material and an upper layer formed of a second elastic material, said first elastic material being less elastic than the second elastic material.

70. An apparatus for making molded panels comprising a porous screen and a plurality of elastomeric pads mounted thereon, each of said pads having a base portion and a body portion above said base, said base having a width greater than or equal to the width of the body, said pads being formed from at least two layers: a first base layer formed of a first elastic material and an upper layer formed of a second elastic material, said first elastic material being less elastic than the second elastic material, said pads being compressible and adapted to form a panel surface having integrally molded thereto an open cell grid comprising ribs substantially normal to said surface and having a flange substantially parallel to said surface when material is deposited and consolidated around said pads.

71. A method for making molded panels comprising a sheet having a plurality of ribs and flanges extending therefrom to form an open cell grid, said method comprising:

providing a porous screen to permit expulsion of fluid therethrough;

providing a plurality of elastomeric pads spaced apart on said screen to serve as molds for forming the open cells of said grid, each of said pads having a base portion and a body portion above said base, said base having a width greater than or equal to the width of the body, said pads being formed from at least two layers: a first base layer formed of a first elastic material and an upper layer formed of a second elastic material, said first elastic material being less elastic than the second elastic material, depositing said material dispersed in fluid onto said screen and around said pads; and consolidating said deposited material and fluid around said pads by compressing said pads to deform them in a direction substantially parallel to said screen, said pads being deformed so that they overhang said screen;

whereby said material is consolidated between said pads and under said overhangs to form on a surface of said panel ribs substantially normal to said surface and having flanges substantially parallel to said surface and across said ribs to form an open grid cell on said panel.

* * * * *